US010163615B2

(12) United States Patent
Fernandez de la Mora

(10) Patent No.: US 10,163,615 B2
(45) Date of Patent: Dec. 25, 2018

(54) HIGH RESOLUTION MOBILITY ANALYSIS OF LARGE CHARGE-REDUCED ELECTROSPRAY IONS

(71) Applicant: Juan Fernandez de la Mora, New Haven, CT (US)

(72) Inventor: Juan Fernandez de la Mora, New Haven, CT (US)

( * ) Notice: Subject to any disclaimer, the term of this patent is extended or adjusted under 35 U.S.C. 154(b) by 0 days.

(21) Appl. No.: 15/076,103

(22) Filed: Mar. 21, 2016

(65) Prior Publication Data

US 2016/0284529 A1 Sep. 29, 2016

Related U.S. Application Data

(60) Provisional application No. 62/135,441, filed on Mar. 19, 2015.

(51) Int. Cl.
*H01J 49/16* (2006.01)
*H01J 49/00* (2006.01)

(52) U.S. Cl.
CPC ..... *H01J 49/167* (2013.01); *H01J 49/0031* (2013.01); *H01J 49/0077* (2013.01)

(58) Field of Classification Search
CPC ..... H01J 49/167; B05B 5/002; B05B 5/003
See application file for complete search history.

(56) References Cited

U.S. PATENT DOCUMENTS

2001/0035494 A1* 11/2001 Scalf ..... H01J 49/165 250/288
2002/0125423 A1* 9/2002 Ebeling ..... H01J 49/044 250/288
2006/0255261 A1* 11/2006 Whitehouse ..... H01J 49/0431 250/288
2007/0102634 A1* 5/2007 Frey ..... H01J 49/0045 250/288
2010/0001181 A1* 1/2010 Moini ..... G01N 27/4473 250/282
2011/0108723 A1* 5/2011 Naqwi ..... B05B 5/0255 250/282
2011/0303839 A1* 12/2011 Robb ..... H01J 49/0054 250/282
2016/0195525 A1* 7/2016 Evoy ..... C07K 14/005 435/6.11

OTHER PUBLICATIONS

Fernandez de la Mora, 'The Fluid Dynamics of Taylor Cones' 2007, Ann Rev Fluid Mech, vol. 39, pp. 217-243.*

* cited by examiner

*Primary Examiner* — Eliza Osenbaugh-Stewart
(74) *Attorney, Agent, or Firm* — Budzyn IP Law, LLC

(57) ABSTRACT

Achieving high conversion of large multiply charged biological ions into low charge states involves requirements difficult to reconcile when high transmission and good spray quality (resulting in narrow mobility distributions) are sought. These multiple goals are achieved in this invention by partially isolating different regions from each other with electrostatic barriers relatively transparent to ions, such as metallic grids. One such region requires high electric fields for ion generation. The other region, used for ion recombination, is approximately field-free. In an alternative arrangement intended for charge reduction in sub-millisecond times, two sources of ions with opposite polarities are placed contiguously, with a grid in between. In all cases, ion crossing through grids into field free regions is effectively driven by space charge.

10 Claims, 6 Drawing Sheets

HIGH RESOLUTION MOBILITY ANALYSIS OF LARGE CHARGE-REDUCED ELECTROSPRAY IONS

CROSS-REFERENCE TO RELATED APPLICATION

This Application claims the benefit of US. Provisional Patent Application 62/135,441, filed Mar. 19, 2015, which is hereby incorporated by reference in its entirety.

BACKGROUND OF THE INVENTION

Electrospray ionization (ESI) converts involatile solutes into gas phase ions for mass spectrometry (MS), as introduced in U.S. Pat. Nos. 4,531,056; 5,581,080; 5,686,726; 6,118,120, among others. ESI ions may also be analyzed via alternative gas phase methods such as ion mobility spectrometry (IMS). ESI's tendency to form multiply charged ions is advantageous to widen the MS's mass range. However, as first noticed by S. F. Wong, C. K. Meng, and J. B. Fenn, (J. Phys. Chem. 1988, 92, 546-550), multiple charging greatly increases the number of peaks present, often resulting in unresolvable spectral complexity. For this reason, various charge-reduction techniques have been described, for instance by Reid G. E., Wells, J. M., Badman, E. R., McLuckey, S. A. (Int. J. Mass Spectrom. 2003, 222, 243-258), and by Scalf, M., Westphall, M. S., Krause, J., Kaufman, S. L. Smith, L. M., (Science, 1999, 283, 194-197). Maximal spectral simplification is evidently achieved by producing dominantly singly charged ions, as described in U.S. Pat. Nos. 5,076,097; 5,247,842; 6,544,484; 7,796,727. This drastic level of charge reduction is not easily made incompatible with the limited mass range of MS detectors in studies of large protein complexes and viruses. However, IMS permits the analysis of singly charged ions of considerable sizes: Certainly up to 30 nm with resolving powers approaching (and possibly exceeding) 40, as discussed by J. Fernandez de la Mora and J. Kozlowski (J. Aerosol Sci., 57, 45-53, 2013). Even larger sizes can be analyzed with some resolution concessions as in the work of Kaufman (J. Aerosol Sci. (29), 537-552, 1998). Furthermore, such massive ions can be detected individually at ambient conditions by growing them into visible drops via vapor condensation in so-called condensation nucleus counters CNCs (also called condensation particle counters, CPCs), as described in U.S. Pat. No. 4,790,650. This sensitive detector is not easily coupled to conventional drift time IMS systems due to its relatively slow response time (~1 s). However, new IMS designs with response times >1 s have already shown promise in the protein size range (i.e. D. R. Oberreit, P. H. McMurry & C. J. Hogan Jr., Aerosol Sci. & Techn., 2014, 48:1, 108-118). When combined with faster CNCs (such as that of J. Wang, V. F. McNeill, D. R. Collins, R. C. Flagan, Aerosol Sci. & Techn., 2002, 36(6), 678-689) these fast IMS systems may improve their current resolving power approaching 20. Differential mobility analyzers (DMAs) following the design of Knutson and Whitby (J. Aerosol Sci., 1975, 6, 443-451) have long offered an alternative to IMS for mobility separation, and are in addition readily compatible with slow detectors. Therefore, the combination of a DMA with charge-reduced electrospray and a CNC detector has demonstrated considerable advantages for the analysis of large biological ions much harder to study by mass spectrometry. This combination, introduced in U.S. Pat. No. 5,076,097, has been termed GEMMA, and has been widely used in numerous applications, as discussed for instance by Guha et al. (Trends in Biotechnology, 2012, 30, 291-300); Kaddis, et al. (J. American Soc. Mass Spectrom., 2007, 18, 1206-1216); Bacher et al. (Mass Spectrom, 2001, 36, 1038-1052), or Maisser et al. (Phys. Chem. Chem. Phys., 2011, 13, 21630-21641), which will be further discussed and referred to as Maisser. The main shortcoming of GEMMA is its limited mobility resolution, typically with relative full width at half maximum (FWHM) >20% for proteins (i.e., FIG. 4a of S. L. Kaufman, J. Aerosol Sci. (29), 537-552, 1998). In contrast IMS spectra of electrosprayed proteins give relative full width at half maximum (FWHM) ~3-4%, both in conventional drift time IMS and in studies based on high resolution DMAs, including cases with charge reduction (FIG. 2 of J. Fernandez de la Mora, S. Ude, B. A. Thomson, Biotechnol. J. 2006, 1, 988-997). This fact, together with the ability of DMAs to reach resolving powers as high as 100 (as in P. Martinez-Lozano and J. Fernandez de la Mora, J. Aerosol Sci., 2006, 37, 500-512), suggests that an improved GEMMA-like method should enable good ion transmission and a resolving power~30 (FWHM~3.33%), limited only by the natural coexistence of several gas phase protein conformations. Several authors [Fernandez de la Mora et al. Biotechnol. J. 2006, 1, 988-997; B. K. Ku, J. Fernandez de la Mora, D. A. Saucy, J. N. Alexander, Anal. Chem. 2004, 76, 814-822.; D. A. Saucy, S. Ude, I. W. Lenggoro, J. Fernandez de la Mora, Anal. Chem., 2004, 76, 1045-1053] have previously reasoned that the limited resolution of GEMMA results from its unconventional electrospraying method (connected to the charge reduction step), giving rise to a substantial and variable level of clustering of involatile residue material on the protein ion. However, the alternative ES-charge-reduction approaches they have proposed have not been widely adopted, perhaps because their charge reduction efficiency, transmission and peak width have not been sufficiently optimized or documented.

Recent signs of increased interest in higher resolution variants of GEMMA must be noted. Laschober, C. S. Kaddis, G. P. Reischl, J. A. Loo, G. Allmaier, W. W. Szymanski (J. Exp. Nanosci. 2007, 2(4) 291-301) have studied combinations of GEMMA's charge reduction with several DMAs and found clearly more compact protein structures for the DMA having a higher resolving power. More recently Maisser used another DMA of even higher resolving power, and found also modest peak width reductions with some native proteins: FWHM>17.6% for all but one (14.7% for ovalbumin). However, these authors discovered a considerable peak narrowing for several small and strongly denatured proteins, with FWHM as low as 8.5%. Good DMA resolution is hence necessary, but not sufficient to achieve narrow peaks.

The acidification advantage just discussed is of great intrinsic interest, offering superficial analogies with the well-known (but not so well understood) role of acids in reducing clustering in ESI-MS (and ESI-IMS). As suggested by Konermann, L., Ahadi, E., Rodriguez, A. D., Vahidi, S., (Anal. Chem., 2013, 85, 2-9), and by Consta, S., Malevanets, A. (Phys. Rev. Lett., 2012, 109, 148301) linear chains (including denatured proteins) can apparently be extruded cleanly out of a charged drop. In contrast, as noted in Fernandez de la Mora, J., Analytica Chimica Acta, 2000, 406, 93-104, globular proteins remain imprisoned in electrosprayed drops until the drops dry, so that the protein inherits the full load of involatile material originally carried by the drop. Unfortunately, the protein extrusion mechanisms of Consta or Konermann are unlikely to happen in singly or doubly charged drops, so the peak narrowing observed by Maisser calls for a different explanation. Acidification is in any case not a general antidote against an imperfect electrospray, first because it is not helpful in the case of protein complexes falling apart at unnatural pH, and also because the observed beneficial effect is minimal at protein masses beyond 40 kDa (FWHM=14.7%→13.4% for ovalbumin in Maisser). Another notable exception to GEMMA's generally wide peaks has been recently reported for viruses by R. You, M. Li, S. Guha, G. W. Mulholland, M. R. Zachariah, Anal Chem, 2014, 86, 6836-6842, who find FWHM in some cases below 5%. This exceptional narrowness perhaps follows from a cleaner virus preparation as well as the closer match between the diameters of the virus and the initial ES drop, which results in a relatively small level of adduction. In conclusion, it appears that much of the resolution problem noted in the case of proteins results from the unusual ESI conditions used in GEMMA. The ES-charge reduction process will therefore be the focus of the present invention.

The key to minimize spectral complexity is to reduce the charge state to unity (z=1), perhaps tolerating a small contribution of doubly charged ions (z=2). Here we shall start the discussion with charge-reduction methods involving the interaction of the ES ions with a bipolar mixture of singly charged anions and cations, produced by ionizing radiation (radioactive sources, UV, X rays) in an initially neutral gas at near ambient pressure. Because these sources produce dominantly monovalent ions, for multiply charged cations, the initial z evolves by interacting with monovalent anions, going sequentially through all the lower charge states $z \rightarrow z-1 \rightarrow z-2, \ldots, \rightarrow 1$. If insufficient reaction time is given, undesirable multiply charged ions survive. For an excessive reaction time, even singly charged ions are neutralized, leading to poor conversion into the z=1 product sought. An optimal reaction time t* may therefore be chosen to maximize the magnitude of the z=1 peak such that the probability of surviving z=2 ions is below a desired threshold, as described by J. Fernandez de la Mora, S. Ude, B. A. Thomson, in Biotechnol. J. 2006, 1, 988-997. As shown in that study, this optimal time depends weakly on the initial charge states $z_{in}$ as $t^*(z_{in}) \sim \ln(z_{in})$, biasing slightly the signal intensity, and complicating quantification in complex mixtures. This difficulty has been ingeniously circumvented in the GEMMA design by tuning t* for the initial ES drops (before they undergo a first Coulomb explosion), which, as shown by de Juan, L., and J. Fernandez de la Mora, J. Coll. and Interface Sci, 1997, 186, 280-293, may be produced with relatively good uniformity of size and charge. The drawback of this early neutralization is that the volume of involatile residue that adducts to the final protein ions is that contained in the volume of the original ES drop, rather than that in the much smaller final drops produced by the usual long series of Coulomb explosions. This increased adduction decreases artificially the mobility, and widens the mobility peak in a fashion reflecting the width of the size distribution of the original ES drops. Accordingly, early neutralization is not ideal for resolution.

Early neutralization is not optimal either for sensitivity. Indeed, ES drops may be initially 10 nm in diameter, and may complete evaporation in sub-microsecond times. Accordingly, achieving drop neutralization prior to the first Coulomb explosion requires special measures, such as the relatively high humidity in the ES chamber recommended in U.S. Pat. No. 5,247,842, and the initial drops larger than those achievable in ES practice. For instance, Kaufman and colleagues (Anal. Chem. 1996, 68, 1895-1904; J. Aerosol Sci. 29, 537-552, 1998) use 20 mM aqueous ammonium acetate, while 100 mM (manageable in practice) would produce typical initial drop volumes 5 times smaller, as explained by Fernandez de la Mora in the Ann. Rev. Fluid Mechanics, 2007, 39, 217-243. The larger initial drop diameter and humidity used to delay drop evaporation also delay the production of analyte ions, resulting in higher space charge broadening and dilution of the ion cloud. Furthermore, the solution concentration must be tuned such that each final drop contains at most one analyte ion, forcing much smaller solution concentrations in initially large non-exploding drops than with initially small drops further atomized by Coulombic explosions. Therefore, both from the sensitivity and the resolution point of view, it is far better to produce the smallest possible ES drops, and evaporate them as completely and as swiftly as possible, as amply confirmed by the well known experience of so-called nanospray. Space charge dilution of the ion cloud evidently continues after complete drop drying, whence fast sampling into an analytical instrument is usually desirable. In our case the ions must first be charge-reduced, which decreases drastically the space charge field E as well as the analyte ion mobility Z (hence the space charge dilution velocity ZE). Accordingly, one should inject the analyte ions into the charge-reduction chamber immediately following complete drop drying, but not before. There is however a difficulty. The formation of a Taylor cone takes place ordinarily at the interface between a conducting fluid (the solution) and an insulating medium (the surrounding gas). If the electric field from the capillary tip penetrates into the charge-reduction region, some of the free ions present there are drawn into the electrospraying chamber, and the medium surrounding the Taylor cone ceases to be strictly insulating. Little is known on the physics of Taylor cone formation under such conditions, other than the readily observable fact that the range of stability of the electrospray is severely curtailed, very much as in situations where an electrical discharge forms at the liquid tip.

Note finally that analyte quantification (relating the measured gas phase concentration to the original solution concentration) when drying before neutralizing is in principle as viable as when neutralizing before drying. Both require corrections due to the size dependence of transport loses and charge-reduction efficiency (both losses are also charge-dependent, but only size counts since the charge on large biomolecules scales with the Rayleigh limit, approximately with the ½ power of molecular volume).

SUMMARY OF THE INVENTION

In view of the background just provided, the charge reduction strategy in this invention will yield low-charge ions displaying much narrower mobility peaks than conventional GEMMA, with excellent ion transmission. The method involves electrospraying relatively small drops from a solution containing one or several analytes, controlling the drop residence time between an electrospraying tip and a charge reduction chamber, such that the smallest drops produced have enough time to dry completely. This combination of small initial drops and uninterrupted secondary atomization results in minimal adduction of involatile residues on the analyte released by complete droplet drying. As shortly as possible after completing this drying, multiply charged ions released from the dried drops are allowed to come in contact with ions of an opposite polarity, subsequently referred to as counterions. This contact is carefully controlled in various respects. First, the contact time between multiply charged ions and counterions must result in the preferential production of singly charged ions. Second, the two kinds of ions are produced in different chambers, and the leakage of electric fields from the electrospraying tip into the charge reduction chamber is carefully controlled to avoid destabilization of the electrospray by counterions following the field lines into the electrospraying chamber. As a result, the electrospraying process remains optimal without interference from the charge reduction process, while the space charge dilution of the original electrosprayed ions prior to charge reduction is minimized, maximizing ion transmission to the analyzer. Other variants of the invention combining an electrospray source with a second source producing primarily ions of the opposite polarity are also described.

GLOSSARY

ESI: Electrospray ionization
MS: mass spectrometry
IMS: ion mobility spectrometry
FWHM: relative full width at half maximum
DMA: Differential mobility analyzer
CR: charge-reduction or charge-reduction chamber
C18: tetraoctadecylammonium ion, $(C_{18}H_{37})_4N^+$
TEAF: triethylammonium formate
IgG : Immunoglobulin G
UV: Ultraviolet

DETAILED DESCRIPTION OF THE INVENTION

Figure 1A:
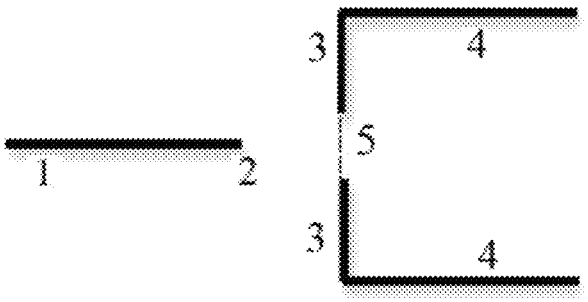
FIG. 1*a* is a schematic of the interior region of a charge-reducing apparatus, showing the capillary (1) supplying the sample solution to the electrospraying meniscus (2) supporting a Taylor cone. This spraying tip faces a thin-plate orifice (3) leading to a charge reduction chamber internally coated with radioactive Ni-63 (4). In a preferred embodiment a conducting grid (5) covers partially the perforation in plate (3). This grid (5) limits penetration of the intense field generated by the capillary tip into the charge reduction chamber. Thus, the flow of counterions from the charge-reduction chamber into the electrospraying tip is greatly reduced, precluding destabilization of the Taylor cone in (2) even when it is brought arbitrarily close to grid (5) to enhance ion transmission.
Figure 1B:
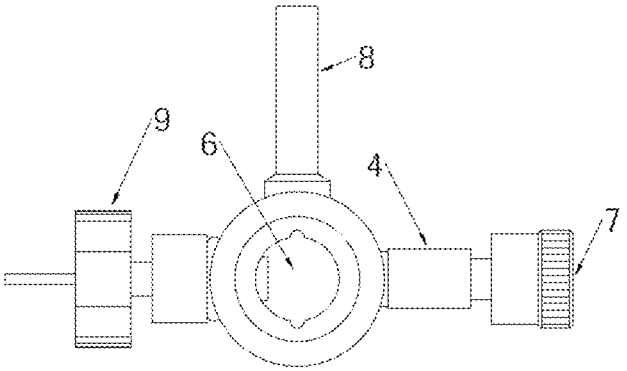
FIG. 1*b* shows the external appearance of a protoype of the apparatus in FIG. 1*a,* where the charge-reduction chamber (4) on the right is a commercial Ultratorr fitting containing within its inner diameter a thin circular tube whose interior wall has been coated with the radioactive beta emitter Ni-63. A window on the electrospray chamber (6) permits visualizing the enclosed ES emitter.

FIGS. 1*a* and 1*b* show the internal and external disposition of a simple ES charge-reduction design addressing various key elements of the invention. Among the internal elements, the ES capillary (1) supplies the sample solution to the electrospraying meniscus tip (2) supporting a Taylor cone, raised to a high voltage with respect to neighboring electrodes. This spraying tip (2) faces an opening (3) on a relatively thin-plate, leading to a charge reduction chamber internally coated with radioactive Ni-63 (4). In a preferred embodiment a conducting grid (5) covers partially the perforation in plate (3). This grid (5) limits penetration of the electric field generated by the capillary tip (2) into the charge reduction chamber (4). Thus, the field-driven flow of counterions from the charge-reduction chamber into the electrospraying tip is greatly reduced. Grid (5) therefore precludes destabilization of the Taylor cone in (2), even when the electrospraying tip (2) is brought very close to grid (5). Close proximity is beneficial in situations such as that displayed in FIG. 1*a,* where the orifice in plate (3) communicating the two chambers is not wide enough to span the full width of the charge reduction chamber (4). Judicious widening of this orifice enables larger tip (2) to grid (5) distances without much loss of analyte ions, since the spray prior to charge reduction is approximately conical with a half angle generally smaller than 45 degrees.

FIG. 1*b* shows the external appearance of a prototype of the apparatus, where the charge-reduction chamber (4) on the right is a commercial Ultratorr (Cajon) fitting containing within its inner diameter a thin circular tube whose interior wall has been coated with 5 mCi of the radioactive beta emitter Ni-63. A window on the electrospray chamber (6) permits visualizing the enclosed ES emitter. The sample gas having gone through the charge-reduction chamber (4) continues through exit port (7) towards the analyzer. Clean gas enters through inlet tube (8), flows through the ES chamber (6), and carries the analyte ion through screen (5). A spraying capillary enters from the left through a leak tight fixture (9), coaxially with the charge-reduction chamber (4). The coaxial arrangement enables moving the emitter tip (2) up and down its axis. This includes positions upstream the thin plate (3) in the presence of a grid, as well downstream from (3) given a suitable opening in the grid, or when grid (5) is replaced by other means subsequently discussed to moderate destabilizing effects of counterions on the electrospray emitter (2). The inner diameter of the CR chamber is slightly larger than the outer diameter of the radioactive source, in this particular case a thin walled Ni cylinder 0.775 cm in outer diameter, 0.7 cm in length (Eckert & Ziegler). The internal wall of this source is coated with 5 mCi of radioactive Ni-63 (~101 years half life), producing β particles with a maximal energy of 67 keV. The rate of ion pair generation within the small volume inside the Ni cylinder can be inferred from the maximal current of 2.2 nA received when replacing the capillary by a metallic cylinder 1/16" in diameter (shown through the window on the axis in FIG. 1*b*), electrically biased with respect to the Ni cylinder in $CO_2$ gas at room temperature and pressure.

In order to control the destabilizing penetration of counterions into the ES chamber, in addition to varying the axial position of the capillary tip, various washers and screens could be placed immediately downstream the thin plate orifice. The charge-reduction chamber is slightly longer than twice the length of the Ni source, whence additional control could be achieved by putting the source either immediately downstream the thin plate orifice (3), or 0.7 cm downstream from it. The first (closer) position was mainly investigated here, though several experiments used two identical sources in series, whose internal walls were each coated with 5 mCi of Ni-63.

A flow rate typically of 1 to 3 L/min of bottled dry air or $CO_2$ entered through the top tube (8) into the ES chamber (5), conveyed the electrosprayed ions of proteins or other species through thin plate orifice (3), and carried them through the CR chamber into the inlet (7) of a differential mobility analyzer (DMA) of the Half-Mini type, where their mobility was determined. This DMA is described by Fernandez de la Mora and Kozlowski in J. Aerosol Sci. 57, 45-53, 2013. Mobility spectra are obtained by fixing an axial flow rate of drift gas in the DMA, fixing also sample inlet and outlet flow rates to the DMA, and scanning over the voltage difference between the two cylindrical DMA electrodes containing an inlet and an outlet slit, respectively. Under these conditions the DMA voltage is strictly proportional to the inverse ion mobility, through a calibration constant determined here with the tetraoctadecylammonium ion $(C_{18}H_{37})_4N^+$, or C18), used as a mobility standard. This ion is the most mobile peak produced by electrospraying an ethanol solution of tetraoctadecylammonium bromide, whose mobility in room temperature air ($Z_s$=0.6 $cm^2$ V/s) was determined in this work, with details recently reported by Fernandez de la Mora (Aerosol Sci. & Techn., 49:1, 57-61, 2015).

The sheath gas used by the DMA was room air at its ambient humidity, with a minimal contribution of $CO_2$ from the much smaller flow of sample gas. The detector used for the DMA-selected ions was not of the sensitive CNC type commonly used in GEMMA. Instead we relied on an operational amplifier electrically connected to a HEPA filter encased in a Faraday cage, where the current of mobility-selected ions in the air flow exiting the DMA at a flow rate of 2-3 L/min was captured and measured. This electrical detector is sensitive enough in our system to give good signal/noise at ~1 μM protein concentration. Experiments without charge-reduction were performed by unscrewing from the ES chamber the Ultratorr fitting (4) holding the Ni-63, and replacing it with an almost identical fitting not containing the radioactive element.

Ovalbumin (chicken egg) and immunoglobulin IgG (rabbit), both from Sigma, were used mostly without any desalting or other purification. In a few final measurements ovalbumin was desalted 6 successive times by centrifugal ultrafiltration of 0.5 cc of a 75 μM solution in deionized water (PALL corporation, cutoff mass of 10 kDa). Ammonium acetate and a solution 1M of triethylammonium formate (TEAF) in water were from Fluka. $(C_{18}H_{37})_4N$—Br was from Sigma Aldrich and Alfa Aesar, respectively.

Electrospraying fused silica capillary emitters 365 μm in outer diameter were either purchased from New Objective (30 μm tip pulled from an original inner diameter of 70 μm), or home-pulled under a flame from a commercial silica capillary (Polymicro). The home-pulled tips spanned diameters from ~15 down to a few μm. The larger tips were polished on a flat rotating alumina surface while rotating the capillary by hand about its axis.

Figure 2:
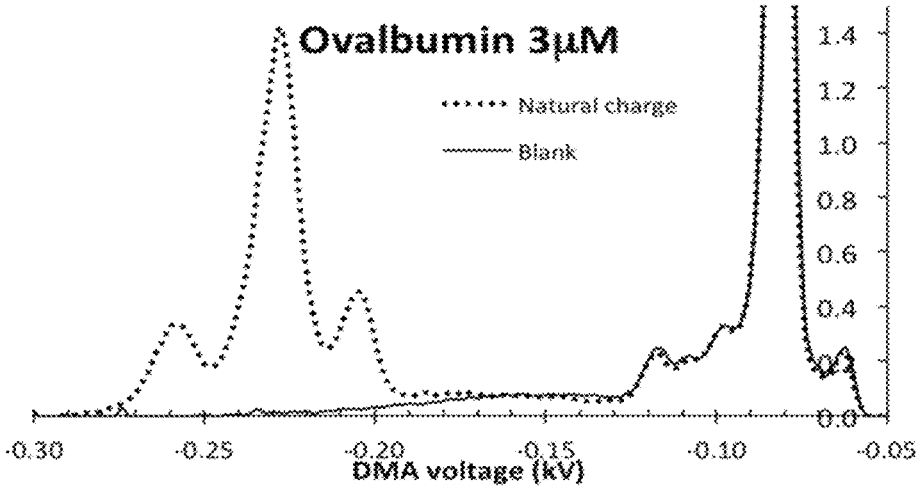
FIG. 2 shows mobility spectra from a 3 μM aqueous solution of the protein ovalbumin, electrosprayed without charge-reduction from 100 mM aqueous triethylammonium formate (TEAF). Continuous line: blank buffer. Dotted line: protein peaks in charge states z=7, 8, 9. The shoulder between −230 and −120 volt is associated to volatile impurity residues from dried drops.

FIG. 2 compares two mobility spectra without charge-reduction, while electrospraying from an aqueous buffer 100 mM in TEAF. One spectrum is for the plain buffer (blank), while the other includes 3 μM Ovalbumin. Ions classified in the inner electrode at high negative voltages are dragged by the sample gas to ground potential against the field inside a semiconducting tube. The sample gas flow rate through the ES chamber into the DMA inlet is 1 L/min. The amplifier response shown in the figures is in volt, with a noise level of a few mV. The blank shows a diversity of reasonably resolved high mobility peaks extending down to −0.12 kV, with a maximum signal of 4.2 volt. These mobile peaks are followed by a broad shoulder extending to −0.230 V, with a maximum intensity of some 70 mV. A similar shoulder is also present in the protein sample, and is due in both cases to solid residues from dried ES drops not containing protein ions. This involatile matter is evidently also present in drops containing proteins, and its adduction to the protein ion is responsible for a fraction of the extra peak broadening previously discussed. These adducts are often removed in the intermediate pressure entry region to mass spectrometers, but this declustering process is harder to implement at atmospheric pressure. A high quality electrospray and a singularly clean sample are therefore most important to achieve narrow peaks. The three multiply charged protein peaks seen in FIG. 2 give a total signal of about 2.2 volt, comparable to the total buffer ion signal of about 5 volt, and close to three orders of magnitude above the electrometer noise. Large space charge losses through the sampling process dilute selectively high mobility species, explaining part of the relative abundance protein/buffer observed.

Figure 3A:
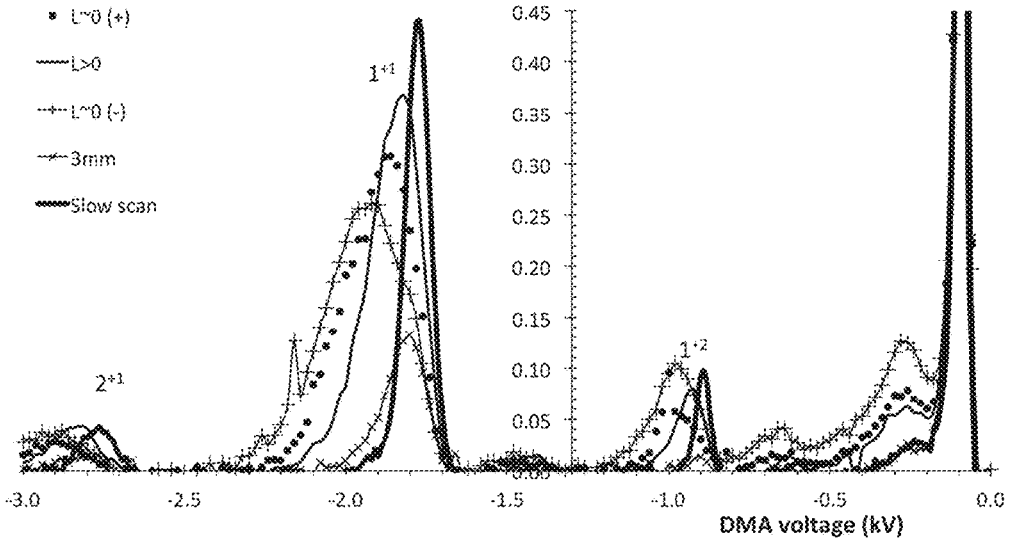
FIG. 3*a* shows charge-reduced mobility spectra of ovalbumin sprayed with a nanospray emitter and grid (5) absent (gridless configuration). The various curves are for different distances L between the emitting tip (2) and partition (3). They illustrate the substantial broadening resulting from neutralizing before evaporation is completed.

Gridless configuration with nanospray tips. FIG. 3*a* shows mobility spectra for charge-reduced sprays of ovalbumin 3 μM in 100 mM TEAF. The notation $n^{+z}$ represents an aggregate of n protein molecules carrying a net balance of z positive elementary charges. The dominant peak is $1^{+1}$, with a clear contribution of $1^{+2}$ at half the voltage. Weak dimer peaks $2^{+1}$ and $2^{+2}$ are also present. The partition between the two chambers is the original 5 mm thin plate orifice (gridless), such that the capillary tip can freely cross from one chamber to the other. The home-pulled and sharpened emitting tip used in these measurements had an unusually small outer tip diameter, in the range of 1 μm, such that the (invisible) Taylor cone remains stable even when the emitter tip is within the charge-reduction chamber. The various spectra in the figure explore the effect of moving axially the tip of the emitting capillary, from a maximum distance L~6 mm to the thin plate orifice partition. The distance measurements are qualitative, but the effect is clear. The unmeasurably small transmitted protein signal at L~6 mm is not shown. On approaching the partition, but before reaching it (even at rather small but still positive L, labeled L>0), the signal increases without clear sign of peak broadening. However, with the needle right at the partition but before reaching it [labeled L~0(+)], and slightly past the partition [labeled L~0(−)], the situation has already become moderately counterproductive in terms of peak height, and highly unfavorable in terms of peak width. The black line in FIG. 3*a* (L=1.5 mm, sample flow rate of 1 Lit/min) was acquired at low enough scan speeds to yield an unbiased peak form. The narrower peaks and the improved signal/noise resulting from better signal accumulation define more clearly the $1^{+2}$ peak, as well as small $2^{+1}$ and $2^{+2}$ peaks (at about 2.8 and 1.4 kV). Although all other spectra in FIG. 3*a* are artificially broadened by fast scanning, the increase in peak width seen on approaching the partition is still significant.

Figure 3B:
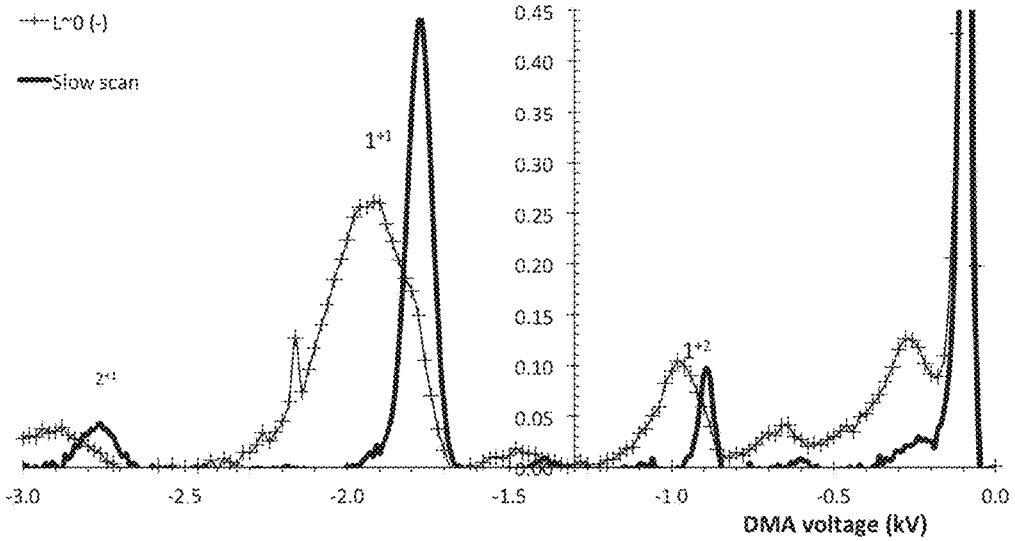
FIG. 3*b* includes only two of the spectra from FIG. 3*a*, displaying more clearly that the spectrum where the spray is not interfered by couterions is much narrower than that where spray quality is compromised.

FIG. 3*b* includes only two of the spectra in FIG. 3*a*, showing even more clearly than before that the spectrum where the spray is not interfered by counterions is much narrower than that where spray quality is compromised. It is unclear if this drastic broadening is due to increase in the size of the initial spray drops (due to the conducting gas surrounding the Taylor cone), or to partial suppression of secondary atomization (due to early neutralization of the drops). Either way, it is clear that the details of the coupling between the ES and the charge reduction chamber may have dramatic effects on mobility peak width.

Figure 4:
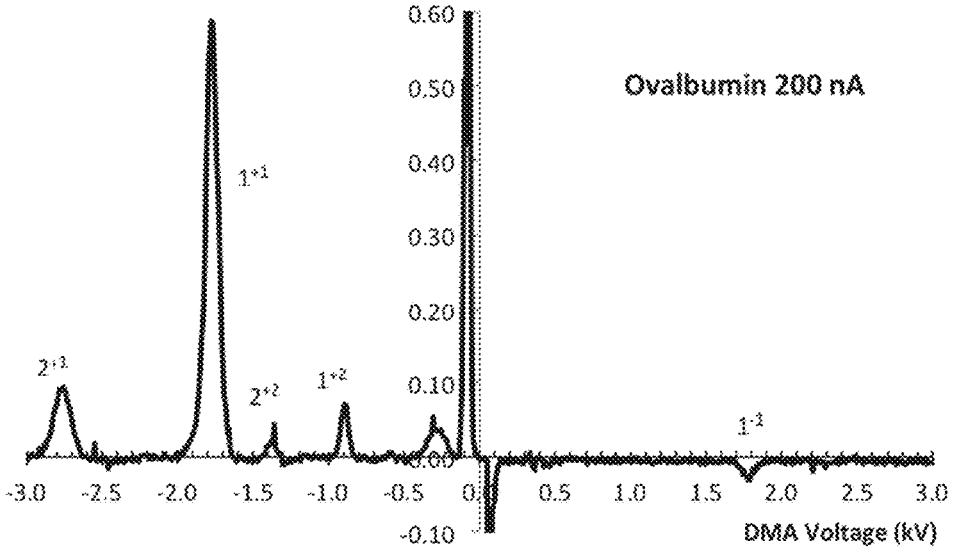
FIG. 4 is a bipolar mobility spectrum with charge reduction in Gridless configuration with L~0.75 mm for an ovalbumin solution. Note a small charge-inverted peak for the singly charged monomer of ovalbumin, denoted $1^{-1}$.

FIG. 4 shows a bipolar mobility spectrum probing positively and negatively charged protein ions. The bipolar spectrum is meant to capture the small fraction of charge-inverted ions having first lost their initial charge to become neutral, and having subsequently acquired a negative charge through a relatively inefficient diffusion process not favored by Coulombic attraction. The data are acquired with the nanospray tip in gridless configuration. The notation $n^{+z}$ represents an aggregate of n protein molecules carrying a net balance of z positive elementary charges. There is a clear $1^{-1}$ peak, whose height is about 20 times less tall than the $1^{+1}$ peak. One reason for this low signal is the substantially smaller cross section for ion-neutral collisions than for collisions between oppositely charged ions. Since the residence time of the system is designed for the later collision types, there is insufficient time for charge inversion. It is however possible to enhance substantially this negative signal. For instance, He and McLuckey [J. Mass Spectr., 2004, 39(11), 1231-1259] have not only illustrated the mass spectrometric advantages of what they refer as charge permutation (charge inversion in our terminology here), but have also achieved it with high cross sections via multiply charged counter-ions. This is not possible with our Ni-63 source, but the inverted signal would be considerably enhanced if the residence time were appropriately tuned, or if our electrical detector were exchanged for a CNC. One advantage of charge inversion is that a near steady state charge distribution may be achieved at long enough residence times, at which (i) the probability $p_2$ of double charging is small compared with the probability $p_1$ of single charging; (ii) the (size-dependent) ratio $p_2/p_1$ is approximately predictable; and (iii) $p_1$ is scarcely dependent on residence time (see, for instance, Friedlander, Smoke, dust, and haze: fundamentals of aerosol dynamics. Oxford University Press, New York, 2000). The resulting ion concentrations in inverted polarity are accordingly far less critically dependent on initial charge and size than when tuning the residence time to maximize the output of z=1 ions of a certain initial charge state.

The data discussed so far are of interest to illustrate what can be achieved with nanospray capillaries that minimize the destabilizing effects of the charge-reducing ion cloud on an emitter exposed to the counterions. However, this interaction is very sensitive to tip geometry, leading to hard to reproduce results when the sharpening technique is not well controlled. For instance, using commercial Picotip capillaries from New Objective pulled into a 30 μm tip OD from an initial 100 μm capillary ID, it is rather hard to stabilize the Taylor cone even when the emitting tip is 3 mm upstream from the thin plate orifice (3). It is interesting that the GEMMA approach is apparently not subject to these problems, yet uses typically a distance L of 3 mm, and relies on tip diameters in the range of 30 μm or more, producing clearly visible Taylor cones. A possible cause for this difference is the much larger volume in the GEMMA charge-reduction chamber, probably limiting the magnitude of the negative ion current that may be drawn into the electrospray region. As long as this current is small enough to be fully consumed in the spray region, without reaching the continuous jet at the tip of the Taylor cone, it cannot affect the stability of the meniscus.

Gridded configuration. In view of the spray stability difficulties encountered, and in order to maintain our compact charge-reduction chamber geometry, we have sought to reduce the penetration of the tip's electric field into the bipolar ion cloud region by reducing with a washer the aperture of the sharp edge orifice. This greatly increases ES stability, but diminishes the efficiency of charge-reduction because the flow of gas going through a smaller opening forms a narrower and faster jet, reducing the time and volume of contact with the bipolar ions. A better partition avoiding this jetting is a metallic grid. For instance, with a square mesh (0.01 inch wire diameter, 30 wires/inch) placed immediately downstream the thin plate orifice partition, the spray is as stable with the radioactive Ni-63 piece in place as without it, even when the capillary tip is brought very close to the partition. The following tests including this gridded geometry have used ovalbumin solutions in 50-100 mM buffers of aqueous ammonium acetate. This salt produces an initial charge state $z_{in}$~14 considerably greater than TEAF, enabling a more rigorous challenge of the charge-reducing capacity of the device.

Figure 5:
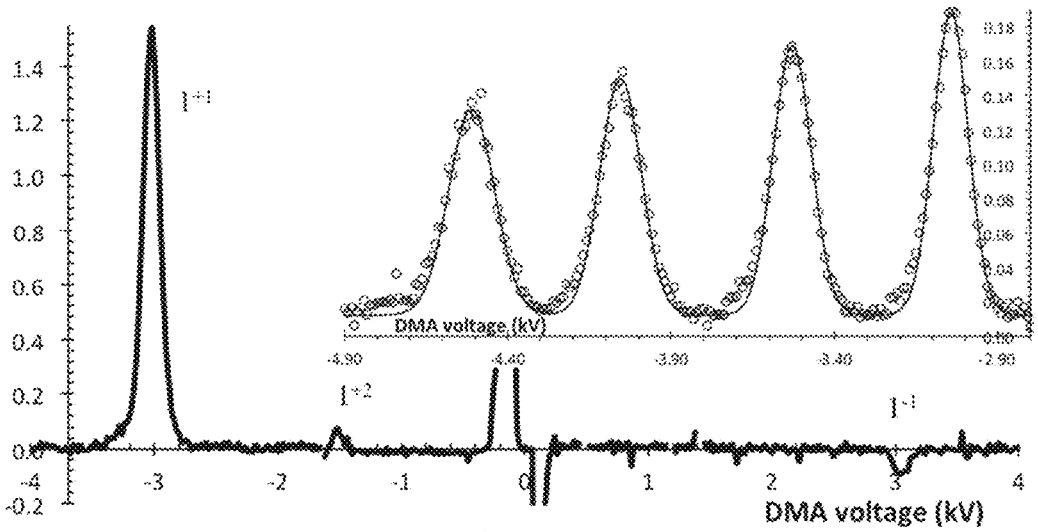
FIG. 5 is a mobility spectrum of ovalbumin for a girdded geometry. Thick line: Bipolar spectrum, showing a dominant $1^{+1}$ ion, with 5% and 6% relative contributions from the z=+2 and the z=−1 ions, respectively (sample flow rate: 2.5 L/min; two Ni-63 rings in series; 2 μM Ovalbumin in 100 mM aqueous ammonium acetate). Inset: four peak shapes for ovalbumin's $1^{+1}$ ion at four flow rates of drift gas increasing from right to left, demonstrating FWHM$_{min}$<3.7% for peaks above 4 kV (Table 1).

FIG. 5 illustrates both the efficient charge reduction for ovalbumin ions, as well as the relatively narrow peaks achievable in the gridded geometry. The sample flow rate is slightly more than twice that in FIG. 4, while the power of the active radioactive source has been doubled (10 mCi).

Figure 6:
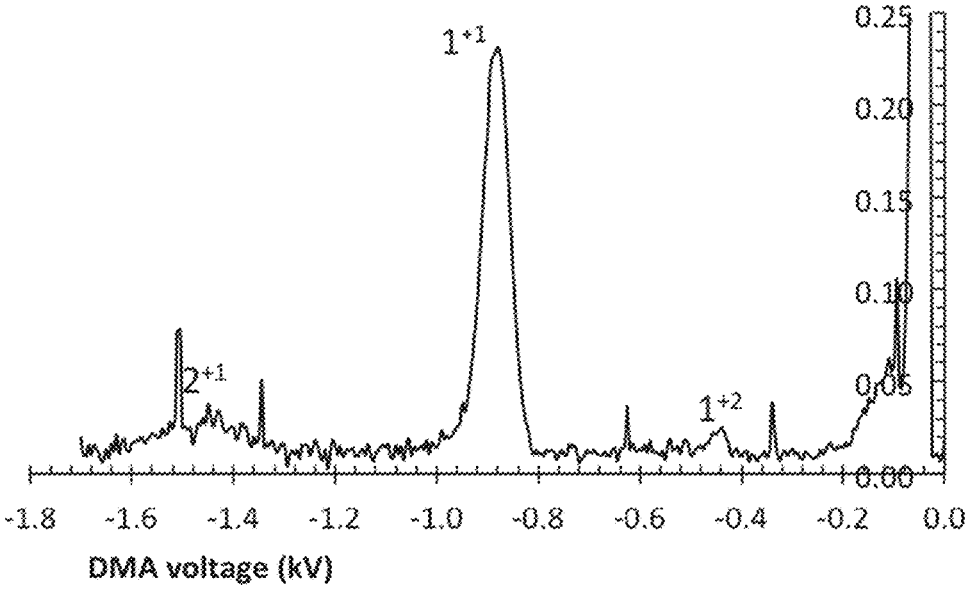
FIG. 6 shows a mobility spectrum of electrosprayed charge-reduced ovalbumin ions with a grid separating both chambers. Note the small contributions from doubly charged monomer and the singly charged dimer. 2.5 μM ovalbumin in 50 mM aqueous ammonium acetate.

The charge reduction power is accordingly similar in both Figures, as seen in the comparable intensity ratios $1^{-1}/1^{+1}$. In spite of the higher initial charge state achieved in ammonium acetate solutions, the level of neutralization is much enhanced by the grid, as evidenced by the ratio of abundances $1^{+1}/1^{+2}$ (~20 here versus ~9 in FIG. 4). This improvement is not surprising because anions penetrating into the gridless ES chamber would be wasted in reactions with the highly charged drops, while a later interaction following complete drop evaporation and conversion of its charge primarily into small singly charged ions would preferentially direct those anions into the most highly charged remaining cations (the proteins). Comparison of peak heights taken at the same sample flow rate in gridless (FIG. 4) versus gridded spectra (FIG. 6) show a ~½ loss of signal in the grid, readily understood given its ~50% transparency. In our situation with no externally imposed electric field following the grid, one might have feared much larger losses due to the protein ions being directed to the mesh by the electric field upstream the grid. The lack of this extra loss indicates that the ES ions self-propel themselves through the screen and downstream from it by their strong space charge field.

This implies that the relatively good transmission efficiency of ions through the present grid would be further improved in a more transparent grid. This would not necessarily imply an undesirable increased anion penetration into the ES region, since this penetration is governed by the size of the opening, which may be controlled independently of transparency by selecting a smaller wire.

On the width of charge-reduced peaks. The thick line data of FIG. 5 correspond to FWHM ~4.9% for the $1^{+1}$ ion. In other measurements and in FIG. 4 we have seen considerably wider peaks (7% in FIG. 3), depending on the cleanness of the solution, the quality of the spray and the flow rates through the DMA. With a freshly made solution of 2.5 μM ovalbumin in 50 mM aqueous ammonium acetate we have achieved FWHM as small as 0.043-0.045, with an observable dependence on DMA parameters. With a moderate desalting effort (via centrifugal ultrafiltration) this width was reduced only slightly down to FWHM=0.042, suggesting that perhaps some of the impurity ions attached to the protein are internal rather than on the surface. Maisser suggests that this possible mode of contamination might be reduced in the case of denatured proteins. We have accordingly briefly investigated a 30 μM ovalbumin solution in 50 mM ammonium acetate including 5% formic acid (inset to FIG. 4). Peaks centered at increasing voltages result from increasing flow rates of drift gas in the DMA, with corresponding FWHM values collected in Table 1. The acidified solution delivers somewhat narrower peaks than the ammonium acetate buffer, with FWHM as small as 0.037. The dependence of this width on DMA setting shows that the DMA has some limiting effect on resolution, suggesting that the intrinsic width of the protein peak may be closer to 3% in desalted acidified solutions.

TABLE 1

Width of mobility peaks in gridded configuration for the singly charged ovalbumin monomer of FIG. 5 (inset) at varying DMA drift gas velocities.

| Peak voltage (kV) | 3.04 | 3.53 | 4.06 | 4.51 |
|---|---|---|---|---|
| FWHM (%) | 4.22 | 3.92 | 3.67 | 3.69 |

Acidification of the solution results in modestly narrower peaks, as well as mobilities slightly larger (~3-4%) than in ammonium acetate. This reduction in cross section is comparable to the variations observed upon increasing the quality of the spray, and may be due to a decrease in adduction rather than to a real compaction of the structure.

Figure 7:
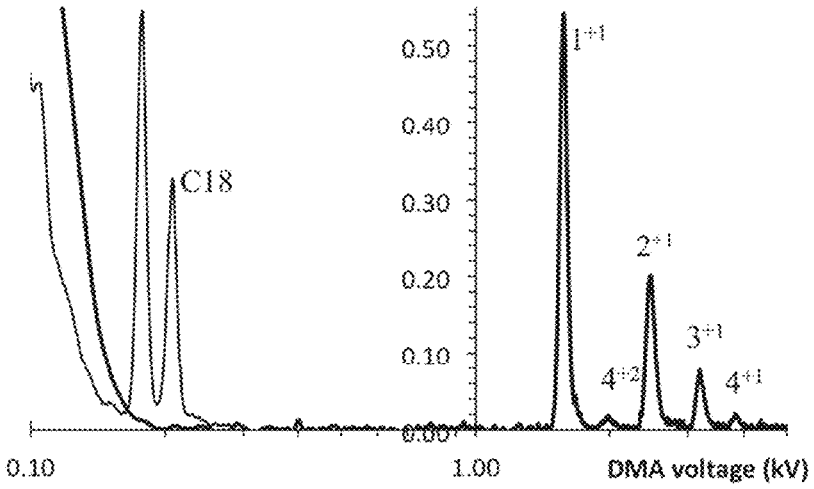
FIG. 7 shows the mobility spectrum of 30 μM ovalbumin including 50 mM ammonium acetate and 5% formic acid (thick line), showing clear peaks from the monomer to the tetramer. The two peaks on the left are from the much more mobile $(C_{18}H_{37})_4N^+$ used as mobility calibration standard.

FIG. 7 shows the mobility spectrum of a concentrated ovalbumin solution producing protein aggregates. It is taken under similar spraying conditions as the inset to FIG. 5, though with a lower sheath gas flow rate and an increased sample flow rate of 1.5 L/min of dry air (rather than $CO_2$) through the ES chamber (only one Ni-63 source). These different operating conditions of the DMA increase substantially the signal and widen the mobility range (as needed to capture the tetramer peak $4^{+1}$). However, they limit the resolution and the charge-reduction power of the device (i.e., survival of the doubly charged tetramer at about 2 kV). The Figure includes also the calibrant ion $(C_{18}H_{37})_4N^+$, enabling determination of the room temperature mobilities of ovalbumin and its aggregates.

Knowing the expected width of protein peaks enables an estimate of the number of individual biomolecules that could be distinguished in a complex mixture. We focus on proteins ranging in mass from 0.1 to 4 MDa, whose singly charged ions would be much harder to analyze with conventional MS detectors. Their surface areas (assuming them to be spheres) and therefore their electrical mobilities with z=1 would span approximately a range $40^{2/3}$. The number N of different proteins that could be differentiated if FWHM were 3% can be estimated as $N=\log(40^{2/3})/\log(1.03)=83$.

Figure 8:
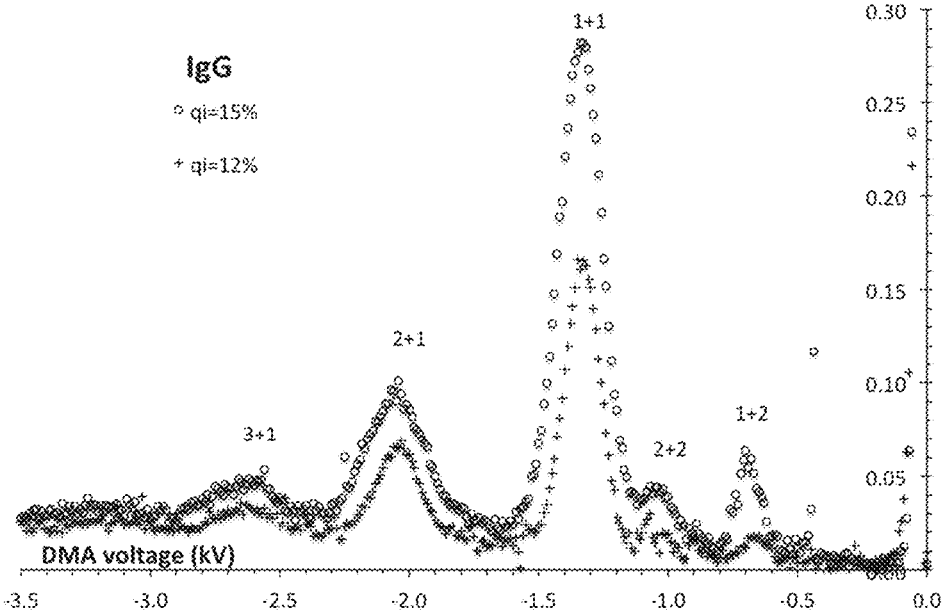
FIG. 8 displays mobility spectra of electrosprayed charge-reduced immunoglobulin G (IgG), showing relatively wide peaks. The two curves, taken at sample flow rates of 1.5 L/min (○) and 1.2 L/min (+) illustrate how the ratio of doubly to singly charged ions decreases at increasing residence time in the neutralizer.

Extrapolations to larger proteins. Because the time theoretically required for reducing the initial charge state $z_{in}$ of a globular ion to unity scales with its mass m as $\ln(z_{in})\sim\ln(m)/2$, a slow deterioration of the charge reduction efficiency (in the form of an increased survival of z=2 ions) should be expected at increasing masses. Besides the Ovalbumin multimer measurements of FIG. 7, we have done a limited exploration of the charge-reduction ability of our device with electrosprays of the larger protein IgG (~150 kDa), as well as aggregates of IgG (up to the trimer; FIG. 8). At a sample flow rate of 1.5 L/min the observed level of charge reduction is insufficient at 300 kD, but becomes adequate at half that flow. In a few exploratory experiments introducing two 10 mCi Ni-63 sources into the charge-reduction chamber we have confirmed that the sample flow rate can be increased approximately twofold while preserving the same z=1 to z=2 abundance ratio. Accordingly, achieving proper charge reduction with samples of several MDa will probably require the wider charge-reduction chambers having previously shown an ability to handle much larger virus particles.

Certain generalizations of the first embodiment of the invention so far discussed will now be introduced. While a radioactive source of counterions offers certain advantages, regulatory requirements have encouraged the development of alternative counterion sources. As previously noted, these have included electrical discharges, ultraviolet (UV) radiation and X-rays. Various authors have achieved charge reduction by combining the products of a positive with a negative electrospray source, as already discussed in relation to the work of McLuckey and colleagues. An electrospray source is particularly indicated when the counterion is multiply charged, since no other ion source is able to produce even doubly charged ions under thermal conditions. As noted by McLuckey and colleagues, negatively charged ions can be produced from cations far more efficiently by combining a singly charged cation with a doubly charged anion, than by attachment of an anion to a neutral molecule. These generalizations are accordingly included in the present invention. Also included are CR chambers considerably larger than the one previously described, which offer an increased ability to charge-reduce very large biological ions such as proteins and viruses. For instance, we have successfully tested a larger cylindrical charge reduction chamber whose axial length and diameter both approach 1", and whose inner cylindrical wall is coated with 10 mCi of Ni-63. This chamber successfully charge-reduces the largest particles tested, corresponding to a virus with a diameter in excess of 60 nm. The advantages of larger chambers are of two kinds. First, the range of β particles is of several cm, so a chamber with a small radius has the problem that β particles emitted from one side of the chamber collide with the opposite side much before their full ionizing power is used. Furthermore, the residence time of analyte ions in the chamber is proportional to the chamber volume, whence a greater charge reduction power is achieved in a larger chamber.

We now address the considerable difference between a charge reduction chamber with a radioactive or an X-ray source, producing approximately as many anions as cations (bipolar source), and one with an ion source primarily of a single polarity, such as a corona discharge or an electrospray source (unipolar source). As the multiply charged analyte cations cross the partition or grid leading into a CR chamber with bipolar ions, the analyte ions all have the same polarity and tend initially to continue expanding laterally by Coulombic repulsion, as they did in the ES chamber. Simultaneously, their space charge repels the cations and attracts the anions present in the bipolar charger, rapidly reducing the space charge loss of analyte ions and enabling good analyte ion transmission even at relatively large residence times. This neutralization takes place without the need to impose electric fields in the charge reduction chamber. The process is essentially driven by space charge. In fact, if electric fields were externally imposed within the CR chamber, the cations would be pushed in a direction opposite to the anions, reducing the chance that the tow ion types would meet to achieve charge reduction, and resulting in the fast loss of ions of both polarities to the walls. For this reason, the interior of the CR chamber must ideally be kept free from fields. This ideal, however, is opposed by the penetration of external fields necessarily existing in the ES chamber into the CR chamber. Accordingly, such a grid or partition is advantageous not only to the quality of the spray (as already noted), but also to the efficiency of the charge-reduction process.

Figure 9:
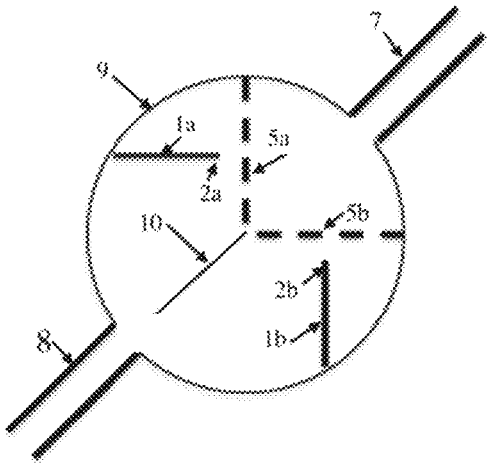
FIG. 9 is a schematic of a configuration of the invention where a charge reduction region confined between grids (5*a*) and (5*b*) receives multiply charged analyte cations from an electrospray source to its right, and neutralizing anions from a second electrospray source below it.

We now consider the case when charge reduction of the analyte ions is achieved primarily with unipolar ions. In this case the two oppositely charged ion clouds attract each other even more efficiently than in the bipolar neutralizer of FIG. 1. Nonetheless, external fields are as damaging in this case as they were in the other, and must be equally avoided. Now the situation is complicated by the fact that the source of neutralizing anions itself requires external fields, while no such fields were necessary when the CR chamber used a bipolar source. The charge reduction region where the two ion clouds meet needs therefore to be shielded from the intense fields existing in the sources of both, anions and cations. The same approaches previously described must hence be implemented here in duplicate. For instance, FIG. 9 is a schematic of an embodiment of the invention with unipolar charge reduction. The tip (2*a*) of a positively charged capillary (1*a*) emits an electrospray cloud of analyte anions, and the tip (2*b*) of a negatively charged capillary (1*b*) emits an electrospray cloud of analyte cations, both ion sources being contained within a single closed chamber (9). The upper right corner of chamber (9) contains also the charge reduction region, electrostatically isolated by screens (5*a*) and (5*b*) from the relatively intense fields in the ion generation region. Clean gas enters into chamber (9) through line (8), crosses through conducting screens (5*a*) and (5*b*) into the charge reduction region, and leaves through exit line (7) carrying charge-reduced analyte ions. The anions and cations fed into the charge reduction region respectively through grids (5*a*) and (5*b*) recombine there in the absence of external fields, leading to the desired charge reduction. In order to achieve a more effective decoupling of the positive and negative emitters, grid (5*a*) may be extended down and grid (5*b*) may be extended to the left such that the two electrosprays are also electrostatically isolated from each other, though this option is not depicted in FIG. 9. Alternatively, a single electrostatic partition (10) depicted in FIG. 9 may be included, either a conducting plate or a grid. This plate or grid (10), grids (5*a*) and (5*b*) an the walls of the chamber are all preferably kept at a fixed voltage, so that the electric fields created by the high positive potential applied to (2*a*) and the high negative potential applied to (2*b*) do not penetrate through these grids or plates. In other words, chamber (9) is divided into three electrostatically independent regions by its external conducting walls, the internal grids (5*a*), (5*b*) and grid or partition (10). These three electrostatically isolating elements must be conducting and charged to approximately the same voltage as the walls of chamber (9). One of these three regions, delimited by grid (5*a*) and partition (10), is devoted to multiply charged cation generation. A second region, delimited by grid (5*b*) and partition (10), is devoted to anion generation. The third region, contained between grids (5*a*) and (5*b*), is devoted to charge reduction. The electrostatic isolation of the two ES emitters offered by (10) is of considerable practical importance for the operation of the device, as it enables independent control of (i) the generation of multiply charged analyte ions and (ii) their subsequent charge reduction. Indeed, the range of currents most favorable for ESI, and the range distances from (5*a*) to (2*a*) most favorable for ion transmission are both limited and should ideally be set irrespective of the level of charge reduction. The level of charge reduction is in turn controlled by the position of tip (2*b*), the voltage $V_b$ applied to it and the flow rate of liquid electrosprayed through tip (2*b*). Naturally, many variants of the electrode and grid configurations depicted would be similarly effective in achieving the desired electrical isolation between the three regions discussed, and are also included in the invention. The invention is not limited either to ES-generated counterions, but includes also alternative sources producing primarily ions of a single polarity, such as a corona discharge. Such sources generally require intense electric fields and would equally benefit from the electrostatic decoupling schemes taught here.

Similarly to the apparatus shown in FIG. 1, the present embodiment includes the freedom to move both capillaries along their axes, such as to change the distances between their tips (2) and the respective grids (5). The current from the spray of multiply charged anions would normally be chosen to minimize the initial size of the electrosprayed drops, while the distance between the tip (2*a*) and the grid (5*a*) would be selected as in the prototype of FIG. 1 so as to maximize ion transmission. The spray current of anions and the distance between the tip (2*b*) and the grid (5*b*) could on the other hand be increased or decreased such as to achieve a desired higher or lower level of charge reduction. Additional control on the level of charge reduction and the transmission of analyte ions may be achieved by moving capillary (1*a*) down (or up) parallel to itself, and similarly moving capillary (1*b*) to the left (or right) so that tips (2*a*)

and (2*b*) approach (depart from) the corner where the two screens meet. The closer the two capillary tips (2) are to this corner, the more intense the two ion clouds will be, favoring a faster and more exhaustive charge reduction process. The angle formed by the two grids is depicted as 90° in FIG. 9, but other angles are also effective, with smaller angles decreasing the volume of the charge reduction region. Likewise, the line of intersection of the two grids has been represented near the center of the chamber, but other positions are also effective depending on the desired charge reduction volume.

The generation of counterions calls for additional details. Radioactive, X ray and UV sources generate typically a multitude of small singly charged ionic species. The nature of these counterions is often difficult to control, since the species initially produced by ionization of carrier gas molecules is quickly transferred to larger contaminating vapor species generally present at very low concentrations. Greater control of the nature of these ions is certainly possible, but it requires high standards of cleanness. Another problem associated to radioactive, X ray and UV sources is that they all involve particles with energies high enough to convert existing organic volatiles into unstable species which tend to aggregate and condense, complicating the initial composition of the gas. An electrospray source of counterions offers a number of advantages, provided it is suitably designed. Electrospraying solutions containing involatile impurities results in the formation of undesirable nanoparticles, each containing the involatile residues from the drying of a solution drop. Electrospraying very pure deionized water yields numerous ion species ($Na^+$, $K^+$, etc.) as well as solid residue nanoparticles. One way to produce primarily a single species of counterions with little company of contaminating nanoparticles is to add substantial quantities of volatile electrolytes to a high purity solvent. For instance, a 100 mM aqueous solution of triethylammonium formate electrosprayed in positive mode produces almost exclusively ions of triethylammonium ($TEA^+$) with very little solid residue composed of exceedingly small nanoparticles (~1 nm). The reason for the smallness of these residues is that the high solution conductivity produces very small initial drops. The reason for the dominance of $TEA^+$ ions is that its high solution concentration and its facile ionization overwhelms all other impurity ions initially in the solution. Another important consideration is that electrospraying requires electric fields comparable to those producing breakdown of the gas. If this takes place, stabilization of the spray is rather difficult or impossible. This problem is particularly acute in negative mode, and in high surface solvents like water. The production of multiply charged biological ions often requires the use of highly conducting aqueous electrolytes, whose tendency to form discharges may be counteracted with properly sharpened capillary tips in the positive mode. For this reason, a preferred mode of operation would combine multiply charged analyte cations from a positive electrospray with anions from a negative electrospray. A preferred solvent to avoid electrical discharges in this negative spray is an organic liquid of moderate surface tension, for instance, methanol or ethanol, both sufficiently polar to dissolve high concentrations of involatile salts. The counterion could be formate from TEAF. However, formate may tend to shed its charge to other solution species and vapor impurities. A larger and more electronegative anion such as trifluoroacetate would be preferable from the viewpoint of minimizing the number of different counterion species. Many other moderately large electronegative anions would be similarly effective.

Another singular advantage already discussed of ESI as a source of counterions is the possibility of producing di-anions, from which charge inversion of the original multiply charged cations can be achieved with much higher efficiency (much higher final concentration of charge-inverted ions) than with singly charged anions. This possibility has never been previously demonstrated at atmospheric pressure, but can be achieved under ambient conditions similarly as previously demonstrated in the vacuum system of tandem mass spectrometers. Suitable electrospraying solutions for di-anion production have been discussed by He, M, J. F. Emory, S. A. McLuckey, Reagent Anions for Charge Inversion of Polypeptide/Protein Cations in the Gas Phase, Anal. Chem. 2005, 77, 3173-3182, and involve preferably di-carboxylic acids such as 2,6-Naphthalenedicarboxylic acid, P-Phenylenedipropionic acid, etc. These weak acids are not suitable to impart high conductivity to the sprayed solutions, which should contain far less than mM concentration of these di-anionic species. The necessary conductivity should be imparted by adding to the solution volatile electrolytes containing ions such as ammonium hydroxide that will not compete for negative charge with the di-carboxylic acid reagents. Those familiar with the art would provide comparable alternatives such that the charge goes predominantly to dianions, while minimizing the production of singly charged anions and solid residues.

Figure 10:
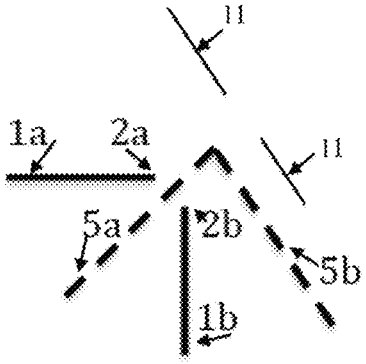
FIG. 10 shows an embodiment of the invention with two spraying chambers of opposite polarity separated by a grid (5*a*), with substantial external electric fields in the region above the grid where charge reduction takes place with particularly high ion concentrations and short residence times.

Another embodiment of the invention will now be discussed enabling charge reduction within unusually short time scales. In the previous embodiments, charge reduction took place in a field-free CR chamber, which needs to be separate from the chamber where the multiply charged analyte ions are generated. Residence times for the ions in the electrospray chamber can be made as short as the evaporation time of the drops, which for volatile nanospray drops 10 or 20 nm in diameter is just a few is, even at room temperature. Residence times in the charge reduction chamber so far discussed are typically much larger. For instance, for a Ni-63 ring 0.7 cm both in length and inner diameter, the residence time is 8 ms at a flow rate of 2 lit/min. For a larger ring 2.4 cm in both inner diameter and length, this time would be 103 ms. For small naturally charged ES ions these long times would be fatal because the signal would decay radically due to space charge repulsion. However, once the spray charge has decreased greatly as a result of charge reduction, high ion transmission can be achieved. On the other hand, there are situations when it is most advantageous to analyze the ions within times smaller than 1 ms following their production. No method to implement charge reduction at such short times has been previously available at near atmospheric pressures. A certain level of charge reduction is however achievable within such short times, as illustrated in FIG. 10. In this new configuration, the requirement of negligible electric fields in the charge reduction region is relaxed, such that the ions may be rapidly transmitted to the analyzer by ion manipulation methods common in atmospheric pressure ion source mass spectrometers. As soon as electric fields are introduced, anions and cations move in opposite directions, so the ion mixing schemes previously practiced need to be substantially modified. Mixing is nonetheless possible as the two ion clouds run onto each other. The special feature of the configuration shown in FIG. 10 is that two ES chambers respectively producing ions of opposite polarities are directly communicated through screen (5*a*), so that anions and cations can leak through (5*a*) from their original chamber to the other chamber, resulting in charge reduction in both chambers. Cations formed at tip (2*a*) entering into the counterion chamber will reduce their charge, but will normally be lost, as they will move upstream towards the emitting tip (2*b*) crossing through an increasingly dense spray of anions. If the current of cations leaking through screen (5*a*) is sufficiently high or their recombination rate with the spray of anions is sufficiently low, some cations will reach the capillary tip (2*b*), potentially destabilizing the negative spray. Note however that this spray is not as delicate as the one producing analyte cations, and will effectively produce small ions even if slightly perturbed in this manner. Counterions having leaked through screen (5*a*) will also move upstream, typically to be completely consumed in the spray of analyte cations, therefore carrying their desired charge reduction function. Partially discharged cations remaining in their original chamber will continue moving in the right direction. The main risk in the configuration in FIG. 10 is that some of the anions having leaked through screen (5*a*) may be able to penetrate upstream through the full spray of cations, reaching the emitting meniscus (2*a*), possibly to the point of destabilizing the positive ES. We have already noted the substantial loss of spray quality that may result from such penetration, and its negative effects on the width of protein peaks. Therefore this eventuality must be avoided, for instance, by weakening the space charge of anions near the region where the spray of multiply charged cations collides with screen (5*a*). There are plenty of control parameters to achieve this goal, such as decreasing the anionic current, or increasing the distance from ES emitter (2*b*) and either emitter (2*a*) or screen (5*a*).

The configuration of FIG. 10 evidently maintains the relatively short residence times typical of a conventional spray chamber, assuring sub-ms residence times even for ions having lost 90% of their original charge. Nonetheless, the fact that the residence times are much shorter than those typical of previously described CR chambers does not necessarily imply that there will be an ineffective charge reduction. The reason is that the recombination rate increases with anion and cation concentration, while both concentrations are greatly increased in the region of coexistence by bringing the two spraying tips much closer to each other than in the configurations of FIGS. 1 and 8.

Once electric fields are allowed to exist in the charge reduction region, additional electrostatic elements can be introduced to extract ions into the analyzer. The reason why electric fields are generally undesirable in the CR chamber is because they push anions and cations in opposite directions, reducing their chances of recombining. However, in the configuration of FIG. 10 the conducting grid (5*a*) separating both ES chambers forces the field to be orthogonal to the grid, so ions of opposite polarity actually run into each other near the screen, favoring quick mixing in the vicinity of grid (5*a*). Electrodes (11) in FIG. 10 form an aperture through which charge-reduced analyte ions are drawn into an analyzer in the upper right region of the figure. In one embodiment, electrodes (11) are at the same potential as grid (5*a*), while an extraction electric field directing the analyte ions towards the analyzer is established by electrodes (not shown) situated to the upper right of electrodes (11). This extraction field will penetrate slightly into the charge reduction region, but its unfavorable effects on counterions may be made relatively minor [comparable or smaller than the attraction from capillary tip (2*a*)] by introducing a relatively small aperture between electrodes (11). In another embodiment, electrodes (11) will be at a slightly negative voltage $V_{11}$ with respect to grid (5*a*), such as to draw downstream more effectively the cations towards the analyzer, though at the expense of repelling further the anions towards the emitting tip (2*a*). Adjustment of $V_{11}$ provides a certain control to better extract cations towards the analyzer, while decreasing and even cancelling the charge reduction efficiency. Grid (5*b*) is maintained at the same potential as grid (5*a*) in order to shield anions produced by tip (2*b*) from the repulsive fields created by electrode (11).

REFERENCES CITED

U.S. Patent Documents

U.S. Pat. No. 4,531,056, July 1985, Labowsky et al., Method and apparatus for the mass spectrometric analysis of solutions U.S. Pat. No. 4,790,650, December 1988, Keady, Condensation nucleus counter U.S. Pat. No. 5,076,097, December 1991, Zarrin et al., Method and apparatus for determining concentration of macromolecules and colloids in a liquid sample U.S. Pat. No. 5,247,842, September 1993, Kaufman et al., Electrospray apparatus for producing uniform submicrometer droplets U.S. Pat. No. 5,581,080, December 1996, Fenn et al, Method for determining molecular weight using multiply charged ions U.S. Pat. No. 5,686,726, November 1997, Fenn et al., Composition of matter of a population of multiply charged ions derived from polyatomic parent molecular species U.S. Pat. No. 6,118,120, Fenn et al., September 2000, Multiply charged ions and method for determining the molecular weight of large molecules U.S. Pat. No. 6,544,484, April 2003, Kaufman et al., Aerosol charge adjusting apparatus employing a corona discharge U.S. Pat. No. 7,796,727 B1, September 2010, Kaufman, Aerosol charge conditioner

Other Publications

Fenn, J. B., Mann, M., Meng, C. K., Wong, S. F., Whitehouse, C. M., Electrospray ionization for mass spectrometry of large biomolecules. Science 1989, 246, 64-71.

S. F. Wong, C. K. Meng, and J. B. Fenn, J. Phys. Chem. 1988, 92, 546-550

Reid G. E., Wells, J. M., Badman, E. R., McLuckey, S. A., Int. J. Mass Spectro 2003, 222, 243-258.

Scalf, M., Westphall, M. S., Krause J., Kaufman, S. L., Smith, L. M., 1999, 283, 194-197.

S. L. Kaufman, J. W. Skogen, F. D. Dorman, F. Zarrin, K. C. Lewis, Anal. Chem. 1996, 68, 1895-1904.

J. Fernández de la Mora and J. Kozlowski, J. Aerosol Sci. (57) 45-53, 2013.

S. L. Kaufman, J. Aerosol Sci. (29), 537-552, 1998

D. R. Oberreit, P. H. McMurry & C. J. Hogan Jr., Aerosol Sci. & Techn., 2014, 48:1, 108-118

J. Wang, V. F. McNeill, D. R. Collins, R. C. Flagan, Aerosol Sci. & Techn., 2002, 36(6), 678-689

Knutson, E. O., & Whitby, K. T., J. Aerosol Sci., 1975, 6, 443-451.

Guha, S., Li, M., Michael, J. Tarlov, Zachariah, M. R., Trends in Biotechnology, 2012, 30, 291-300

C. S. Kaddis, S. H. Lomeli, S. Yin, B. Berhane, M. I. Apostol, V. A. Kickhoefer, L. H. Rome, J. A. Loo, J. American Soc. Mass Spectrom., 2007, 18, 1206-1216.

G. Bacher, W. W. Szymanski, S. L. Kaufman, P. Zollner, D. Blaas, G. Allmaier, J. Mass Spectrom, 2001, 36, 1038-1052.

A. Maisser, V. Premnath, A. Ghosh, T. A. Nguyen, M. Attoui, C. J. Hogan, Phys. Chem. Chem. Phys., 2011, 13, 21630-21641.

J. Fernández de la Mora, S. Ude, B. A. Thomson, Biotechnol. J. 2006, 1, 988-997

P. Martínez-Lozano and J. Fernández de la Mora, J. Aerosol Sci., 2006, 37, 500-512

B. K. Ku, J. Fernandez de la Mora, D. A. Saucy, J. N. Alexander, Anal. Chem. 2004, 76, 814-822.

D. A. Saucy, S. Ude, I. W. Lenggoro, J. Fernandez de la Mora, Anal. Chem., 2004, 76, 1045-1053.

C. Laschober, C. S. Kaddis, G. P. Reischl, J. A. Loo, G. Allmaier, W. W. Szymanski, J. Exp. Nanosci. 2007, 2(4) 291-301

Konemann, L., Ahadi, E., Rodriguez, A. D., Vahidi, S., Anal. Chem., 2013, 85, 2-9

Consta, S., Malevanets, A., Phys. Rev. Lett., 2012, 109, 148301

Fernandez de la Mora, J., Analytica Chimica Acta, 2000, 406, 93-104.

R. You, M. Li, S. Guha, G. W. Mulholland, M. R. Zachariah, Anal Chem, 2014, 86, 6836-6842.

de Juan, L., and J. Fernández de la Mora, J. Coll. and Interface Sci, 1997, 186, 280-293

Kaufman, S. L., Zarrin, F. and Dorman, F., U.S. Pat. No. 5,247,842, 1993.

J. Fernández de la Mora, Ann. Rev. Fluid Mechanics, 2007, 39, 217-243.

J. Fernández de la Mora, Aerosol Sci. & Techn., 2015, 49:1, 57-61.

Ude S., J. Fernández de la Mora, *J. Aerosol Sci.,* 2005, 36:1224-1237.

May, J. C., C. R. Goodwin, N. M. Lareau, K. L. Leaptrot, C. B. Morris, R. T. Kurulugama, A. Mordehai, C. Klein, W. Barry, E. Darland, G. Overney, K. Imatani, G. C. Stafford, J. C. Fjeldsted, J. A. McLean, Anal. Chem. 2014, 86, 2107-2116

He, M.; McLuckey, S. A., J. Mass Spectr., 2004, 39(11), 1231-1259

He, M, J. F. Emory, S. A. McLuckey, Anal. Chem. 2005, 77, 3173-3182

Friedlander, S. K., Smoke, dust, and haze: fundamentals of aerosol dynamics. Oxford University Press, New York, 2000.

C. J. Hogan, J. Fernandez de la Mora, J. Am. Soc. Mass Spectr., 2011, 22, 158-172.

J. Fernandez de la Mora, R. Borrajo-Pelaez, M. Zurita-Gotor, J. Phys. Chem. B 2012, 116, 9882-9898

Hogan, C.; Ruotolo, B.; Robinson, C.; Fernandez de la Mora, J., J. Phys. Chem. B, 2011, 115(13), 3614-3621.

J. Fernandez de la Mora, R. Borrajo-Pelaez, M. Zurita-Gotor, J. Phys. Chem. B 2012, 116, 9882-9898

Fernández de la Mora, Aerosol Sci. & Techn., 49:1, 57-61, 2015.

The invention claimed is:

1. A method to achieve narrow mobility distributions, high transmission, and substantial conversion of multiply charged analyte ions in the gas phase into primarily singly charged analyte ions via charge-reduction, according to the following steps:

a) generating said gas phase analyte ions by electrospraying from an electrospray source held at a given polarity a solution containing precursors to said analyte ions, said electrospraying producing charged drops of said solution within an electrospraying (ES) region, said charged drops evaporating, being further divided by secondary atomization and releasing said multiply charged analyte ions into the gas phase;

b) providing a second region maintained at a gas pressure comparable to the gas pressure in said ES region, said second region generating counterions of a polarity opposite to the polarity of said multiply charged analyte ions via a second electrospray source;

c) partially isolating said ES region from said second region with an electrostatic barrier configured to substantially block interpenetration of electric fields between said ES region and said second region, yet allow passage of said counterions or said multiply charged analyte ions between said two regions, such that:

(i) said electrospray source is sufficiently distant from said electrostatic barrier for said charged drops to evaporate substantially and be further divided multiple times by secondary atomization prior to reaching said electrostatic barrier;

ii) some among said multiply charged analyte ions and said counterions cross said electrostatic barrier and interact with each other, resulting in reduction of the charge state of said multiply charged analyte ions; and, iii) destabilization of said electrospraying due to electric field penetration between said ES region and said second region is moderated by said electrostatic barrier;

d) drawing said charge-reduced multiply charged analyte ions for subsequent utilization.

2. The method of claim 1, wherein said electrostatic barrier includes a perforated conducting surface.

3. The method of claim 1, wherein said electrostatic barrier includes a conducting grid.

4. The method of claim 3, wherein said interaction of said multiply charged analyte ions and said counterions across said electrostatic barrier is increased by selecting said conducting grid to have transparency above 30% , wire diameter smaller than 0.04".

5. The method according to claim 4, wherein said conducting grid has a transparency exceeding 50%.

6. The method of claim 1, wherein said counterions carry more than one elementary charge.

7. The method of claim 1, wherein said electrospray source includes a capillary, and, wherein said solution includes volatile salts at concentrations above 30 mM, such as to produce drops with small diameters smaller than produced by smaller salt concentrations, the faster evaporation of said drops permitting placing said capillary much closer to said conducting grid than at smaller salt molarities, greatly enhancing the concentration of said multiply charged analyte ions crossing through said electrostatic barrier.

8. The method of claim 1, wherein said electrostatic barrier is placed between said electrospray source of said given polarity and said second electrospray.

9. The method of claim 1, wherein said charge-reduced multiply charged analyte ions drawn for subsequent utilization have a polarity opposite to said given polarity.

10. A method to achieve narrow mobility distributions, high transmission, and substantial conversion of multiply charged analyte ions in the gas phase into primarily singly charged analyte ions via charge-reduction, according to the following steps:

a) generating said gas phase analyte ions by electrospraying from an electrospray source held at a given polarity a solution containing precursors to said analyte ions, said electrospraying producing charged drops of said solution within an electrospraying (ES) region, said charged drops evaporating, being further divided by secondary atomization and releasing said multiply charged analyte ions into the gas phase;

b) providing a second region maintained at a gas pressure comparable to the gas pressure in said ES region, said second region including means to generate counterions, said means to generate counterions including one or more of an electrical discharge, a second electrospray source, a radioactive source, X-rays, and UV photons, said counterions primarily being of a polarity opposite to the polarity of said multiply charged analyte ions, wherein said counterions carry more than one elementary charge;

c) partially isolating said ES region from said second region with an electrostatic barrier configured to substantially block interpenetration of electric fields between said ES region and said second region, yet allow passage of said counterions or said multiply charged analyte ions between said two regions, such that:

(i) said electrospray source is sufficiently distant from said electrostatic barrier for said charged drops to evaporate substantially and be further divided multiple times by secondary atomization prior to reaching said electrostatic barrier;

ii) some among said multiply charged analyte ions and said counterions cross said electrostatic barrier and interact with each other, resulting in reduction of the charge state of said multiply charged analyte ions; and, iii) destabilization of said electrospraying due to electric field penetration between said ES region and said second region is moderated by said electrostatic barrier;

d) drawing said charge-reduced multiply charged analyte ions for subsequent utilization.

* * * * *